United States Patent [19]

Ikenoue et al.

[11] 4,076,539

[45] Feb. 28, 1978

[54] PROCESS FOR PREPARING SILVER HALIDE DISPERSIONS

[75] Inventors: Shinpei Ikenoue; Takao Masuda, both of Asaka, Japan

[73] Assignee: Fuji Photo Film Co., Ltd., Kanagawa, Japan

[21] Appl. No.: 693,670

[22] Filed: Jun. 7, 1976

Related U.S. Application Data

[63] Continuation-in-part of Ser. No. 491,006, Jul. 23, 1974, abandoned.

[30] Foreign Application Priority Data

Jul. 23, 1973 Japan ..... 48-82851

[51] Int. Cl.[2] ..... G03C 1/38; G03C 1/02

[52] U.S. Cl. ..... 96/114.5; 96/94 R; 96/94 BF

[58] Field of Search ..... 96/94 R, 94 BF, 114.5, 96/107

[56] References Cited

U.S. PATENT DOCUMENTS

| | | | |
|---|---|---|---|
| 2,240,471 | 4/1941 | Swan | 96/114.5 |
| 2,240,472 | 4/1941 | Swan | 96/114.5 |
| 2,240,476 | 4/1941 | Simmons et al. | 96/114.5 |
| 2,271,622 | 2/1942 | Carroll et al. | 96/114.5 |
| 2,275,727 | 3/1942 | Carroll et al. | 96/114.5 |
| 2,463,794 | 3/1949 | Murray | 96/94 R |
| 2,752,246 | 6/1956 | Weaver | 96/94 R |
| 3,241,970 | 3/1966 | Popeck | 96/94 R |
| 3,434,841 | 3/1969 | Kuhrt | 96/114.5 |
| 3,699,114 | 10/1972 | Ohkubo et al. | 96/94 R |
| 3,761,273 | 9/1973 | Miller et al. | 96/114.5 |

*Primary Examiner*—Mary F. Kelley

*Attorney, Agent, or Firm*—Sughrue, Rothwell, Mion, Zinn and Macpeak

[57] ABSTRACT

A process for preparing a silver halide dispersion which comprises reacting a solution of a compound capable of releasing a halogen ion with a solution of a compound capable of releasing a silver ion in the presence of a surface active agent, said silver halide also having been dispersed in a mixture of water and an organic solvent slightly soluble in water present during or after the preparation of said silver halide dispersion.

21 Claims, No Drawings

PROCESS FOR PREPARING SILVER HALIDE DISPERSIONS

CROSS-REFERENCE TO RELATED APPLICATION

This application is a continuation-in-part application of Ser. No. 491,006, filed July 23, 1974, and now abandoned by Shinpei Ikenoue et al, entitled "PROCESS FOR PREPARING SILVER HALIDE DISPERSIONS", now abandoned.

BACKGROUND OF THE INVENTION

1. Field of the Invention

The present invention relates to a process for preparing a silver halide dispersion, and more particularly, it relates to a process for forming a fine-grain silver halide dispersion.

2. Description of the Prior Art

When a fine-grain silver halide dispersion has been prepared, a water-soluble polymer such as gelatin or polyvinyl alcohol has been generally utilized as a protective colloid, whereby the silver halide is prevented from coagulating. However, since the protective colloid has low solubility in an organic solvent, it is very difficult for the formed fine-grain silver halide to be uniformly dispersed in an organic solvent.

Polyvinyl pyrrolidone or the polymers disclosed in U.S. Pat. Nos. 3,706,564 and 3,706,565 can be utilized in order to disperse silver halide in an organic solvent after preparing the silver halide in an aqueous solution. That is, the polymer is dissolved in water, a silver halide is prepared in the aqueous polymer solution, the polymer is coagulated and then the aqueous liquid containing the silver halide is redispersed in the organic solvent.

However, often the presence of polymer as a protective colloid is not required. For example, such a polymer is not present in a heat-developable light-sensitive material as disclosed in U.S. Pat. Nos. 3,152,904 and 3,457,075. The light-sensitive material requires the contact of an organic silver salt with a photo-catalyst such as silver halide. In this case, if the polymer as a protective colloid is strongly adsorbed on the silver halide, undesirably the catalytic contact of the organic silver salt with the silver halide is prevented.

On the other hand, if a silver halide is prepared utilizing a polymer which functions as a protective colloid only slightly or without utilizing a polymer as a protective colloid, the silver halide coagulates to form coarse grains, and as a result thereof, it is difficult to catalytically contact the silver halide with an organic silver salt.

SUMMARY OF THE INVENTION

Therefore, an object of the invention is to provide a process for preparing a fine-grain silver halide dispersion in the absence of a binder as a protective colloid.

Another object of the invention is to provide a process for forming a fine-grain silver halide dispersion capable of being dispersed in an organic solvent.

A further object of the invention is to provide a fine-grain silver halide dispersion useful for a light-sensitive material.

As the result of much research, it has been found that a fine-grain silver halide dispersion prepared in the presence of a surface active agent is stable and coagulation is restrained even though a polymer as a protective colloid is not present. It has further been found that, when organic solvent slightly soluble in water is added to the silver halide dispersion, the silver halide is dispersed in the organic solvent in a stable manner and enhance the protection of silver halide from coagulation.

Accordingly, this invention provides a method of preparing a silver halide dispersion which comprises reacting a solution of a compound capable of releasing halide ions with a solution capable of releasing silver ions in the presence of a surface active agent, said silver halide also having been dispersed in a mixture of water and an organic solvent slightly soluble in water present during or after the preparation of silver halide dispersion.

DETAILED DESCRIPTION OF THE INVENTION

In the invention, all kinds of surface active agents can be used. That is, a cationic surfactant, an anionic surfactant, an amphoteric surfactant and a non-ionic surfactant are all effective to prevent the silver halide from coagulating.

Of the surfactants, cationic surfactants and non-ionic surfactants are particularly preferred. For example, a cationic surface active agent whose counter ion is a halogen ion can preferably act in the invention as a compound capable of releasing a halogen ion because it reacts with the silver ion to form the silver halide. Even though a cationic surface active agent which does not provide an anion capable of forming a water soluble silver salt, i.e., the counter ion is an anion such as a nitrate ion, or a non-ionic surface active agent which cannot provide such an anion to react with the silver ion is used, the effects of the invention are still achieved.

Specific examples of cationic surface active agents, are ammonium salts which include the compounds represented by the general formula (I),

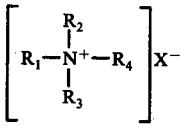

(I)

wherein $R_1$ is an alkyl group having 8 to 22 carbon atoms, preferably 12 to 18 carbon atoms such as dodecyl, tetradecyl, hexadecyl, and octadecyl; $R_2$, $R_3$ and $R_4$ each is an alkyl group having 1 to 10 carbon atoms, preferably 1 to 4 carbon atoms such as methyl, ethyl, propyl, and butyl, or an aralkyl group such as benzyl, phenylethyl, methylbenzyl, naphthylmethyl, etc.; and $X^-$ is a halogen ion such as bromide, chloride or iodide, capable of forming silver halide when reacted with silver ion, or an ion incapable of forming a weakly soluble silver compound when reacted with silver ion, such as nitrate ion or perchlorate ion.

The typical examples of ammonium salts represented by the general formula (I) are as follows:

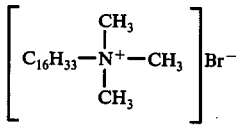

-continued

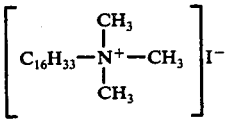

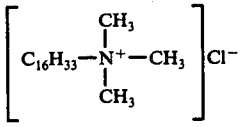

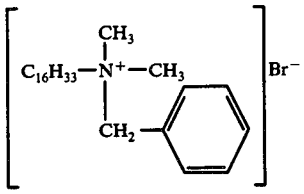

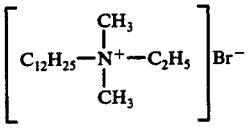

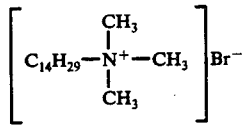

An another type of ammonium salt is an alkyl pyridinium salt which includes the compounds represented by the general formula (II),

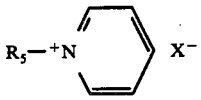

(II)

wherein $R_5$ is an alkyl group having 8 to 22 carbon atoms, preferably 12 to 18 carbon atoms as defined for $R_1$; and X is as defined with respect to the general formula (I). The pyridine ring can be substituted with a substituent such as an alkyl group or an aryl group, e.g., methyl, ethyl, propyl, phenyl, tolyl, etc.

The typical examples of the compounds represented by the general formula (II) are as follows:

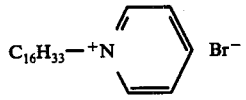

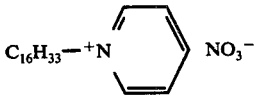

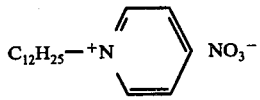

-continued

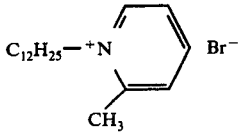

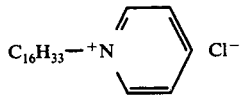

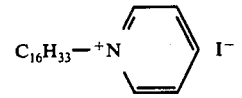

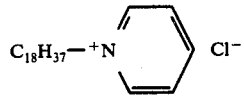

A non-ionic surface active agent can be suitably used in the process of invention even though it does not react with silver ion.

Typical examples of non-ionic surfactants are alkylether type compounds and alkylaryl ether type compounds. More specific compounds can be represented by the general formula (III) and (IV).

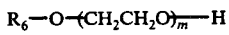

(III)

(IV)

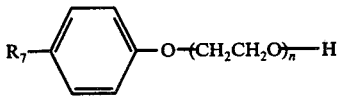

wherein $R_6$ is an alkyl group having 8 to 22 carbon atoms, preferably 12 to 18, as defined for $R_1$, $R_7$ is an alkyl group having 4 to 10 carbon atoms (e.g., butyl, pentyl, hexyl, heptyl, octyl, nonyl, and decyl), and *m* and *n* each is an integer of 8 to 50.

Specific examples of compounds represented by the general formulae (III) and (IV) are as follows:

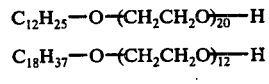

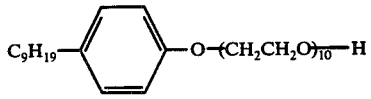

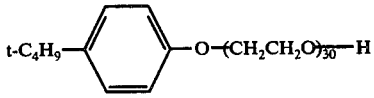

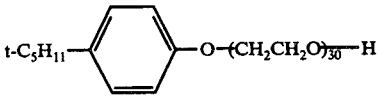

Further, an alkylester type non-ionic surfactant and a sorbitan monoalkylester type non-ionic surfactant are effective. For example, such compounds can be represented by the general formulae (V) or (VI)

$$R_8-COO(CH_2CH_2O)_nH \quad (V)$$

$$R_8-COO(CH_2CH_2O)_{n-1}CH_2CH_2COOR_8 \quad (VI)$$

wherein $R_8$ is an alkyl group having 8 to 18 carbon atoms (e.g., octyl, nonyl, decyl, dodecyl, tetradecyl, hexadecyl, and octadecyl) and $n$ is an integer of 3 to 40, or the general formula (VII)

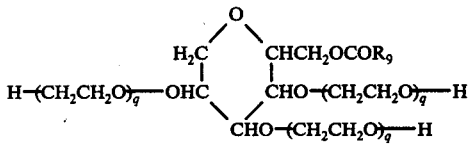

wherein $R_9$ is an alkyl group having 8 to 18 carbon atoms, e.g., as defined for $R_8$ and $q$ is an integer of 5 to 30.

Typical examples of compounds represented by the general formulae (V), (VI) and (VII) are as follows:

$C_{14}H_{29}-COO(CH_2CH_2O)_{10}H$
$C_{14}H_{29}-COO(CH_2CH_2O)_{9}CH_2CH_2COOC_{14}H_{29}$
$C_{16}H_{33}-COO(CH_2CH_2O)_{22}H$
$C_{16}H_{33}-COO(CH_2CH_2O)_{16}CH_2CH_2COOC_{17}H_{35}$

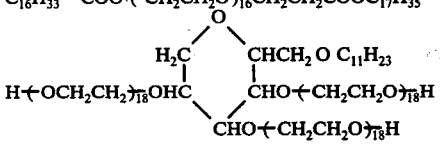

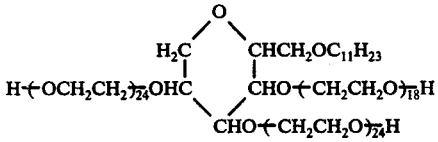

Still further, a polyoxyethylene alkylamine type nonionic surfactant is effective in the invention. For example, these compounds can be represented by the general formula (VIII),

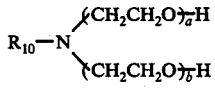

(VIII)

wherein $R_{10}$ is alkyl group having 8 to 18 carbon atoms, e.g., as defined for $R_8$, and $a$ and $b$ each is an integer of 0 to 20, and the sum of $a + b$ ranges from 6 to 40.

Typical examples of compounds of the general formula (VIII) are as follows:

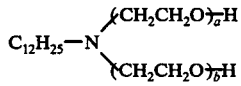

(a + b = 20)

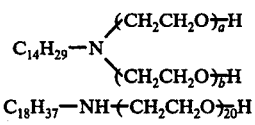

(a + b = 10)

$C_{18}H_{37}-NH(CH_2CH_2O)_{20}H$

Typical examples of anionic surfactants are those compounds having the general formula (IX)

$$R_{11}COOM \quad (IX)$$

wherein $R_{11}$ is an alkyl group having 10 to 22 carbon atoms, and M is sodium, potassium or ammonium.

Suitable specific examples thereof include sodium laurate, ammonium laurate, potassium myristate, sodium palmitate, ammonium stearate, etc.

Suitable examples of amphoteric surfactants, can be represented by the general formula (X) and (XI)

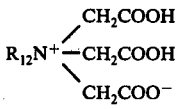

(X)

wherein $R_{12}$ is an alkyl group having 12 to 18 carbon atoms, e.g., as defined for $R_1$;

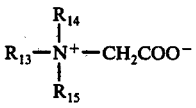

(XI)

wherein $R_{13}$ is an alkyl group having 12 to 18 carbon atoms, e.g., as defined for $R_1$; and $R_{14}$, $R_{15}$ each is an alkyl group having 1 to 4 carbon atoms, e.g., as defined for $R_2$.

Suitable specific examples of these amphoteric surface active agents are as follows:

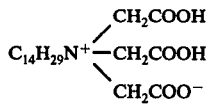

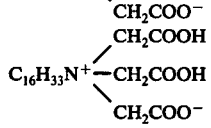

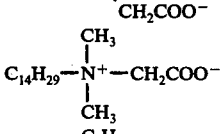

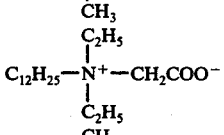

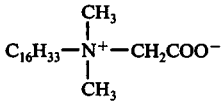

Although it is preferred that a surfactant be used in an aqueous solution, it can be used in another polar solvent such as methanol, ethanol, dimethyl formamide or dimethyl sulfoxide. The concentration of the surfactant is about 0.3 to 30 wt%, preferably 1 to 10 wt%. A suitable molar ratio of the silver halide to the surface active agent can range from about 1:8 to 1:0.01, preferably 1:4 to 1:0.1.

In addition to the aqueous solution, a slightly water-soluble solvent (e.g., 10 parts or less per 100 parts of water, preferably 2 parts or less per 100 parts of water, at 20° C) is utilized in order to enhance the protection of silver halide from coagulation and to disperse the silver halide in the oil phase. A combination of water and a solvent which hardly dissolves in water is most preferred. A suitable ratio of water to the solvent is about 1:10 to 10:1, preferably 1:6 to 6:1, by volume. Said organic solvent slightly soluble in water is utilized during or after the preparation of silver halide dispersion.

Emulsification of water and a organic solvent slightly soluble in water brings about the better protection of silver halide from coagulation.

The most preferred process comprises mixing a solution of a compound capable of releasing a halide ion and a solution of a compound capable of releasing silver ion in the presence of a surface active agent and an organic solvent slightly soluble in water which has been emulsified with water.

Preferred solvents are those which are liquid at room temperature (about 20° to 30° C), for example, the esters of alcohols having from 1 to about 12 carbon atoms or phenols having from about 6 to 12 carbon atoms with phosphoric acid, phthalic acid or carboxylic acids which are liquid at normal temperature (about 20° to 30° C) as well as. In addition, aliphatic hydrocarbons having 5 to 12 carbon atoms and aromatic hydrocarbons are also useful. Suitable examples of such alcohols are butyl alcohol, ethanol, methanol, octyl alchol, isoamyl alcohol, etc., and of such phenols are cresol, phenol, etc.

Preferred examples of solvents are tricresyl phosphate, tributyl phosphate, monooctyldibutyl phosphate, dimethyl phthalate, dioctyl phthalate, dimethoxyethyl phthalate, amyl acetate, isoamyl acetate, isobutyl acetate, isopropyl acetate, isobutyl acetate, ethyl acetate, 2-ethylbutyl acetae, butyl acetate, propyl acetate, dioctyl sebacate, dibutyl sebacate, diethyl sebacate, diethyl succinate, propyl formate, butyl formate, amyl formate, ethyl valerate, diethyl tartarate, methyl butyrate, ethyl butyrate, butyl butyrate, isoamyl butyrate, pentane, hexane, heptane, cyclohexane, benzene, toluene, and xylene.

Silver halide dispersion used in the invention can be prepared using any conventional method. That is, a method in which a solution containing a silver compound capable of releasing a silver ion is added to a solution containing a halogen compound capable of releasing a halogen ion, a method in which a solution containing a halogen ion and a solution containing a silver ion are simultaneously mixed, and a method in which a solution containing a halogen ion is added to a solution containing a silver ion are effective.

As the solution containing the halogen ion or silver ion, an aqueous solution can be generally used, and other polar solvents such as methanol, ethanol, dimethylformamide or dimethyl sulfoxide can be also utilized. But an aqueous solution is most preferred.

A surface active agent can be included either in the solution of the compound capable of releasing the halogen ion or in the solution of the compound capable of releasing the silver ion, or in both solutions. The process of the invention can be carried out by adding simultaneously the solution of the compound capable of releasing the silver ion and the solution of the compound capable of releasing the halogen ion. Preferably a surface active agent is included in the mixture of water and an organic solvent slightly soluble in water.

Where a cationic surface active agent having a halogen ion as a counter ion is used, the solution containing the surface active agent also acts as the solution of the compound capable of releasing the halogen ion.

As compounds capable of releasing the halogen ion, examples are inorganic compounds represented by the general formula, $$MX'_{n_1}$$

wherein M is a hydrogen atom, an ammonium group or a metal (e.g., strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, mangananese, gallium, indium, rhodium, ruthenium, palladium, iridium, platinum, thallium, bismuth, etc.) atom; X' is a halogen atom (e.g., chlorine bromine, iodine); and $n_1$ is 1 when M is a hydrogen atom or an ammonium group and $n_1$ is the valence of the metal when M is a metal atom.

Further, organic halide compounds such as triphenylmethyl chloride, triphenylmethyl bromide, acetic acid monoiodide, N-bromosuccinimide, N-bromoacetamide, N-iodoacetamide, iodoform or carbon tetrabromide can be used.

The halogen ion-releasing compound can be used alone or as a mixture of two or more compounds. The concentration of the halogen ion-releasing compound can be widely varied. Preferably, the concentration is about $10^{-4}$ mol/liter to a saturated solution. As the compounds which release halogen ion, those compounds whose solubility in water is greater than 1 g/100 ml (at 20° C) are preferred.

As compounds capable of releasing a silver ion, silver nitrate can be generally utilized, and a water soluble silver salt having a solubility of higher than about 0.2 g/100 g $H_2O$ at 20° C such as silver perchlorate, silver sulfate or silver acetate can also be utilized. The silver ion can be a complex ion such as a silver ammonium complex salt, a silver amine complex salt such as $Ag^+[(C_2H_5)_3N]_2$, $Ag^+(H_2NCH_2CH_2NH_2)_2$, etc.

The concentration of the compound capable of releasing the silver ion can also be widely varied, and preferably the concentration is about $10^{-4}$ mol/liter to a saturated solution.

The reaction temperature of the halogen ion-releasing compound and the silver ion-releasing compound can be any temperature lower than the boiling point of the solvent, and the temperature is generally about 0° to 80° C, preferably 5° to 50° C.

Effective silver halides in the invention are silver chloride, silver bromide, silver iodide, silver chlorobromide, silver chloroiodide, silver chloroiodobromide and a mixture thereof.

As described above, the silver halide is dispersed in a solution which is obtained by emulsifying a slightly soluble solvent in water in the presence of a surface active agent, whereby the silver halide is stabilized and is prevented from coagulation. In this case, the organic solvent slightly soluble in water can be added at any step in the formation of the silver halide. That is, it can be added before the formation of the silver halide, after the formation of the silver halide or during the formation of the silver halide dispersion. Preferably said organic solvent slightly soluble in water is added before or during the formation of the silver halide dispersion. The emulsification can be carried out using well-known methods. For example, a shaker, a mixer, a colloid mill, a homogenizer or ultrasonic waves can be used.

According to the invention, although a high molecular weight compound such as gelatin as a binder is absent, a stable dispersion of silver halide particles can be prepared. Accordingly, where the use of binder is inconvenient, the process of the invention is very useful in preparing a fine grain silver halide dispersion. According to the invention, the silver halide can be dispersed in a non-aqueous solvent. A silver halide dispersion prepared by the process of the invention is also useful as a silver halide catalyst for thermally developable light-sensitive materials.

The invention will be illustrated in greater detail by reference to the following Examples. Unless otherwise indicated, all parts, percents, ratios and the like are by weight.

EXAMPLE 1

To an aqueous solution of cetylethyldimethyl ammonium bromide which was both the surface active agent and the halogen ion-releasing compound, 2.5 ml of a 1 N aqueous solution of a silver nitrate was added dropwise to prepare a silver bromide dispersion. The solution of the surface active agent was prepared by dissolving 0.95 g of cetylethyldimethyl ammonium bromide in 20 ml of water. The thus obtained dispersion was uniformly cloudy and silver bromide did not precipitate on the bottom of reaction vessel.

The dispersion was allowed to stand for 24 hours and most of the silver halide was suspended in the water although a small amount of the silver halide settled on the bottom of the vessel. That is, the turbidity of the dispersion was substantially the same as the turbidity directly after the preparation thereof.

For comparison, 0.25 g of ammonium bromide was dissolved in 20 ml of water to prepare an aqueous solution to which 25 ml of an 1 N aqueous solution of silver nitrate was then added dropwise. In this case, silver bromide was immediately precipitated and the supernatant liquid was completely transparent.

As is apparent from these results, the surface active agent prevents the coagulation of the silver halide particles.

EXAMPLE 2

To 50 ml of water, 0.95 g of cetylethyldimethyl ammonium bromide was dissolved and then 100 cc of toluene was added and the emulsification was carried out over a period of 10 minutes using an ultrasonic generator.

With stirring, 2.5 ml of 1 N aqueous solution of silver nitrate was added dropwise at room temperature to the emulsified liquid to prepare an aqueous silver bromide dispersion.

The thus prepared aqueous dispersion of silver bromide separated in about 30 minutes into two phases, a water phase and a toluene phase, each of which contained silver bromide as a uniform dispersion. That is, when the dispersion was exposed to room light, the two phases were uniformly colored. The silver bromide in the water phase and in the toluene phase was very stable, and when it was allowed to stand for more than one month, the silver bromide did not settle.

EXAMPLE 3

In 20 ml of water, 1 g of

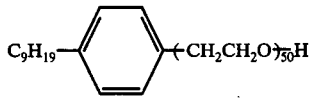

and 0.24 g of ammonium bromide were dissolved. The solution was heated to 30° C and 2.5 ml of a 1 N aqueous silver nitrate solution was added dropwise to the solution with stirring to prepare a silver bromide dispersion.

The dispersion was stable, similar to the dispersion prepared in Example 1.

EXAMPLE 4

In 50 ml of water, 1 g of

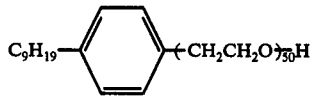

and 0.25 g of ammonium bromide were dissolved. 100 cc of toluene was added to the solution and then the mixture was emulsified using a ultrasonic generator similar to Example 2 over a period of 10 minutes. With stirring the emulsion, 2.5 ml of a 1 N aqueous solution of silver nitrate was added dropwise at 35° C to prepare an aqueous dispersion of silver bromide.

The dispersion separated into a water phase and a toluene phase in about 30 minutes and silver bromide was uniformly dispersed in the two phases. That is, when the dispersion was exposed to room light, it was observed to be uniformly colored.

The silver bromide in the water phase coagulated after about 3 days, but the silver bromide in the toluene phase was very stable and was stable on standing for more than 2 weeks without coagulation. That is, the silver bromide was uniformly dispersed in the toluene phase.

EXAMPLE 5

The same procedure as in Example 1 was repeated except that an aqueous solution of cetylpyridinium bromide prepared by dissolving 0.96 g of cetylpyridinium bromide in 20 ml of water was used instead of the aqueous solution of cetylethyldimethyl ammonium bromide. The silver bromide dispersion thus prepared was stable similar to that in Example 1.

EXAMPLE 6

The same procedure as in Example 4 was repeated at 50° C except that $C_{16}H_{33}$-COO-$(CH_2CH_2O)_{22}$H was used instead of

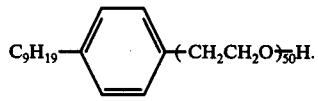

The silver bromide emulsion thus prepared was stable similar to that in Example 4.

EXAMPLE 7

To an aqueous solution of cetylethyldimethyl ammonium bromide prepared by dissolving 4.75 g of cetylethyldimethyl ammonium bromide in 50 ml of water, 250 cc of toluene was added and emulsified over a period of 10 minutes using a ultrasonic generator similar to the method of Example 2. With stirring the emulsion at room temperature, 2.25 g of silver nitrate dissolved in 25 ml of water was added at room temperature to prepare a silver bromide dispersion.

On the other hand, 15 g of silver laurate was dispersed in 240 g of a 15 wt% isopropanol solution of polyvinyl butyral having an average molecular weight of 1000. To the dispersion, 30 ml of the silver bromide dispersion was added and dispersed using homogenizer.

After the following components (2) to (4) were added to 20 g of the thus prepared silver salt dispersion (silver laurate and silver bromide), the dispersion was coated on a paper support in an amount of 0.5 g/m$^2$ to prepare Light-Sensitive Material (A).

After the following components (1) to (4) were added to 20 g of the polymer dispersion, the mixture was coated on a paper support in an amount of 0.5 g/m$^2$ to prepare a Light-Sensitive Material (B).

1. Silver Bromide-Forming Agent 1 ml of a 7.3 wt% methanol solution of cetylethyldimethyl ammonium bromide 2. Sensitizing Dye 3 ml of a 0.025 wt% methanol solution of 2,7-dichlorofluorescein 3. Black Toning Agent 3 ml of a 1.25 wt% methanol solution of phthaladinone 4. Reducing Agent 3.5 ml of a 20 wt% acetone solution of p-phenylphenol These Light-Sensitive Materials (A) and (B) were exposed to a tungsten lamp ($10^5$ CMS) and then heated to 120° C for 30 second, whereby images were formed.

The sensitivity which was the reciprocal of the exposure amount necessary for providing a reflection density of fog + 0.1 was measured and the results obtained are shown in the Table. The sensitivity was relative sensitivity.

| | Light-Sensitive Material | |
|---|---|---|
| | (A) | (B) |
| Sensitivity | 610 | 100 |

As is apparent from the results in Table, the light-sensitive material of the invention has higher sensitivity.

While the invention has been described in detail and with reference to specific embodiments thereof, it will be apparent to one skilled in the art that various changes and modifications can be made therein without departing from the spirit and scope thereof.

What is claimed is:

1. A process for preparing silver halide dispersion in the absence of a binder as a protective colloid which comprises reacting an aqueous solution of a compound capable of releasing halogen ions with an aqueous solution of a compound capable of releasing silver ions wherein said compound capable of releasing silver salt having a solubility of higher than about 0.2g/100g. $H_2O$ at 20° C. to form a silver halide product wherein a surface active agent is present in the reaction mixture and wherein an organic solvent sightly soluble in water is added to one of said two solutions before said reaction or to the reaction mixture during said reaction or after said reaction wherein said organic solvent slightly soluble in water has a solubility of 10 parts or less per 100 parts of water at 20° C.

2. The process of claim 1, wherein said surface active agent is a cationic surface active agent, an anionic surface active agent, an amphoteric surface active agent, and a non-ionic surface active agent.

3. The process of claim 2, wherein said surface active agent is a cationic surface active agent or a non-ionic surface active agent.

4. The process of claim 3, wherein said surface active agent is a cationic surface active agent represented by the General Formula (I);

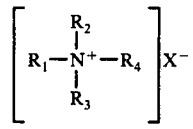

(I)

wherein $R_1$ is an alkyl group having 8 to 22 carbon atoms; $R_2$, $R_3$ and $R_4$ each is an alkyl group having 1 to 10 carbon atoms or an aralkyl group; and X is an anion; or an alkyl pyridinium salt represented by the General Formula (II);

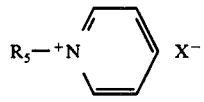

(II)

wherein $R_5$ is an alkyl group having from 8 to 22 carbon atoms; and X is as defined with respect to General Formula (I); and wherein the pyridine ring moiety can be substituted with an alkyl group or an aryl group substitutent.

5. The process of claim 3, wherein said surface active agent is non-ionic surfactant and is an alkyl ether compound having the General Formula (III)

$$R_6-O-(CH_2CH_2O)_m-H \quad \text{(III)}$$

wherein $R_6$ is an alkyl group having 8 to 22 carbon atoms; and m is an integer of 8 to 50;

an alkylaryl ether compound having the General Formula (IV);

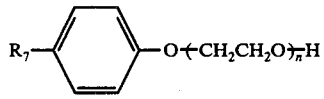

(IV)

wherein $R_7$ is an alkyl group having 4 to 10 carbon atoms; and n is an integer of 8 to 50;

an alkyl ester compound represented by the General Formula (V) or the General Formula (VI);

$$R_8-COO-(CH_2CH_2O)_p-H \quad \text{(V)}$$

$$R_8-COO-(CH_2CH_2O)_{p-1}-CH_2CH_2COOR_8 \quad \text{(VI)}$$

wherein $R_8$ is an alkyl group having 8 to 18 carbon atoms; and p is an integer of 3 to 40;

a sorbitan monoalkyl ester compound having the General Formula (VII);

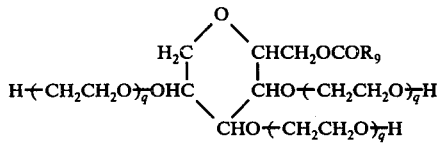

(VII)

wherein $R_9$ is an alkyl group having 8 to 18 carbon atoms; and $q$ is an integer of 5 to 30; or a polyoxyethylene alkylamine having the General Formula (VIII)

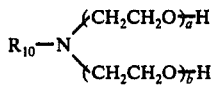

(VIII)

wherein $R_{10}$ is an alkyl group having 8 to 18 carbon atoms; a and b each is an integer of 0 to 20; and the sum of a and b ranges from 6 to 40.

6. The process of claim 1, wherein said compound capable of releasing a halogen ion is an inorganic compound represented by the General Formula:

$$MX'_{n_1}$$

wherein M is a hydrogen atom, an ammonium group or a metal atom; X' is a halogen atom; and $n_1$ is 1 when M is a hydrogen atom or an ammonium group and $n_1$ is the valence of the metal atom when M is metal atom; or an organic halide compound selected from the group consisting of triphenylmethyl chloride, triphenylmethylbromide, monoiodoacetic acid, N-bromosuccinimide, N-bromoacetamide, N-iodoacetamide, iodoform and carbon tetrabromide; wherein said compound capable of releasing a silver ion is a water soluble silver salt having a solubility of higher than about 0.2 g/100 of water at 20° C; wherein either said aqueous solution of said halogen ion-releasing compound or said aqueous solution of said silver ion includes said solvent slightly soluble in water; and wherein the concentration of said surface active agent ranges from about 0.3 to 30% by weight.

7. The process of claim 1, wherein said surface active agent is present in said solution of said compound capable of releasing a halogen ion.

8. The process of claim 2, wherein said surface active agent is present in said solution of said compound capable of releasing a halogen ion, in said solution of said compound capable of releasing silver ion, or in both of said solutions.

9. The process of claim 1, wherein the molar ratio of said silver halide to said surface active agent is from about 1:8 to 1:0.01.

10. The process of claim 9, therein said molar ratio of said halide to said surface active agent is from 1:4 to 1:0.1.

11. The process of claim 1, wherein the volume ratio of said water to said solvent is about 1:10 to 10:1.

12. The process of claim 11, wherein said volume ratio is 1:6 to 6:1.

13. The process of claim 1, wherein said solvent is liquid at room temperature.

14. The process of claim 13, wherein said solvent is selected from the group consisting of esters of alcohols having from 1 to 12 carbon atoms and phenols having from 6 to 12 carbon atoms with phosphoric acid, phthalic acid and carboxylic acid, aliphatic hydrocarbons having 5 to 12 carbon atoms and aromatic hydrocarbons.

15. The process of claim 14, wherein said solvent is tricresyl phosphate, tributyl phosphate, monooctyldibutyl phosphate, dimethyl phthalate, dioctyl phthalate, dimethoxyethyl phthalate, amyl acetate, isoamyl acetate, isobutyl acetate, isopropyl acetate, isobutyl acetate, ethyl acetate, 2-ethylbutyl acetate, butyl acetate, propyl acetate, dioctyl sebacate, dibutyl sebacate, diethyl sebacate, diethyl succinate, propyl formate, butyl formate, amyl formate, ethyl valerate, diethyl tartarate, methyl butyrate, ethyl butyrate, butyl butyrate, isoamyl butyrate, pentane, hexane, heptane, cyclohexane, benzene, toluene or xylene.

16. The process of claim 1, including the step of subsequently emulsifying said silver halide dispersion.

17. The process of claim 1, wherein said water soluble silver salt is selected from the group consisting of silver nitrate, silver perchlorate, silver sulfate, silver acetate, a silver ammonium complex salt and a silver amine complex salt.

18. The process of claim 17, wherein said silver ammonium complex salt has $Ag^+[(C_2H_5)_3N]_2$ ions or $Ag^+(H_2NCH_2CH_2NH_2)_2$ ions.

19. The process of claim 1, wherein said compound capable of releasing silver ions is silver nitrate.

20. The process of claim 1, wherein said organic solvent slightly soluble in water has a solubility of 2 parts or less per 100 parts of water at 20° C.

21. The process of claim 1, wherein said organic solvent slightly soluble in water is added to one of said aqueous solutions prior to said reaction.

* * * * *